US006739904B2

(12) United States Patent
Wu

(10) Patent No.: US 6,739,904 B2
(45) Date of Patent: May 25, 2004

(54) CABLE CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 38 days.

(21) Appl. No.: 10/264,384

(22) Filed: Oct. 4, 2002

(65) Prior Publication Data

US 2004/0067680 A1 Apr. 8, 2004

(51) Int. Cl.[7] ..... H01R 9/07
(52) U.S. Cl. ..... 439/497
(58) Field of Search ..... 439/497, 579

(56) References Cited

U.S. PATENT DOCUMENTS 5,387,125 A * 2/1995 Davis et al. ..... 439/497
6,394,839 B2 * 5/2002 Reed ..... 439/497
6,489,563 B1 * 12/2002 Zhao et al. ..... 174/88 C

* cited by examiner

*Primary Examiner*—Neil Abrams
*Assistant Examiner*—Phuong K Dinh
(74) *Attorney, Agent, or Firm*—Wei Te Chung

(57) ABSTRACT

A cable connector assembly (100) for use with a complementary connector includes an electrical connector (1), a cable (2) having signal conductors (22) and drain wires (23), a spacer (3) and ground plates (4). A terminal holder (14) of the connector has a printed circuit board (142) attached thereto, which defines a number of first and second conductive pads (144, 145) on opposite surfaces (147, 148) thereof. The first conductive pads are soldered to terminals (143) of the connector and signal pads (145*a*) of the second conductive pads are soldered to the signal conductors of the cable to thereby establish signal paths between the cable and the complementary connector. While, soldering portions (43) of the ground plates and drain wires are oppositely positioned on the opposite sides of the printed circuit board and are soldered to corresponding ground pads (145*b*) of the second conductive pads to thereby establish first and second ground paths between the cable and the complementary connector.

9 Claims, 19 Drawing Sheets

CABLE CONNECTOR ASSEMBLY

CROSS-REFERENCE TO RELATED APPLICATIONS

This patent application is a Co-pending application of U.S. patent application Ser. No. 10/209,553 filed on Jul. 30, 2002, entitled "ELECTRICAL CONNECTOR HAVING A LATCH MECHANISM" and is related to U.S. Patent Application with an unknown serial number entitled "CABLE CONNECTOR HAVING A LATCH MECHANISM".

BACKGROUND OF THE INVENTION

1. Field of the Invention

The present invention generally relates to a cable connector assembly, and particularly to a cable connector assembly for transmitting high speed signals in an interconnection system.

2. Description of Prior Arts

As the density of interconnects and the transmitting rate of the signals tremendously increase, the close proximity of the contacts in the connectors and the large amount of data with high speed increase the likelihood of strong electrical cross talk coupling between both the contacts and the wires used in the interconnection system. In the case of cables with electromagnetic interference (EMI) shielding, the cable shield is typically coupled to designated contacts in the connectors which are, in turn, coupled to designated terminals in the complementary connectors. Such a ground connection is adequate for most applications, while in the case of high frequency signal, particularly when differential signal pairs are employed in the cables, problems can arise if the transfer impedance and the cross talk are not sufficiently reduced. Shield connections that do not have low enough transfer impedance and cross talk can result in unacceptable high levels of electromagnetic emissions from the cable or unacceptable susceptibility to external sources of electromagnetic radiation.

Ground means are widely used for ground connection of a variety of cable connector assemblies. Such applications of ground means can be found in U.S. Pat. No. 5,522,731 issued to Berg Technology, Inc. on Jun. 4, 1996, U.S. Pat. No. 6,152,754 issued to Masimo Corporation on Nov. 28, 2000, U.S. Pat. No. 6,394,839 issued to Tensolite Company on May 28, 2002, and U.S. Pat. No. 6,203,369 issued to 3M Innovative Properties Company on Mar. 20, 2001.

Hence, a cable connector assembly having a substantial low cross talk and transfer impedance during high rate signal transmission is eagerly required.

BRIEF SUMMARY OF THE INVENTION

Accordingly, an object of the present invention is to provide a cable connector assembly, which has ground plates for substantially reducing cross talk occurred between signal wires of a cable and for particularly reducing cross talk occurred on soldering area where the signal wires are soldered to signal conductive pads of a printed circuit board.

In order to achieve the above-mentioned object, a cable connector assembly in accordance with the present invention is adapted for use with a complementary connector and comprises an electrical connector, a cable having signal wire pairs and drain wires, a spacer attached to the cable and ground plates for grounding purpose. Each ground plate has a soldering portion positioned between the signal wire pairs and conductively connecting with corresponding drain wire. A terminal holder of the electrical connector has a printed circuit board attached to a rear side thereof, which defines a number of first and second conductive pads on opposite surfaces thereof. The ground plates and the drain wires are oppositely arranged on opposite sides of the printed circuit board. The first conductive pads are soldered to terminals of the electrical connector for receiving signals from the complementary connector. The second conductive pads have signal pads soldered to the signal wires of the cable to thereby establish signal paths between the cable and the complementary connector. While, ground pads of the second conductive pads are soldered to the corresponding drain wires and the ground plates to thereby establish first and second ground paths between the cable and the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
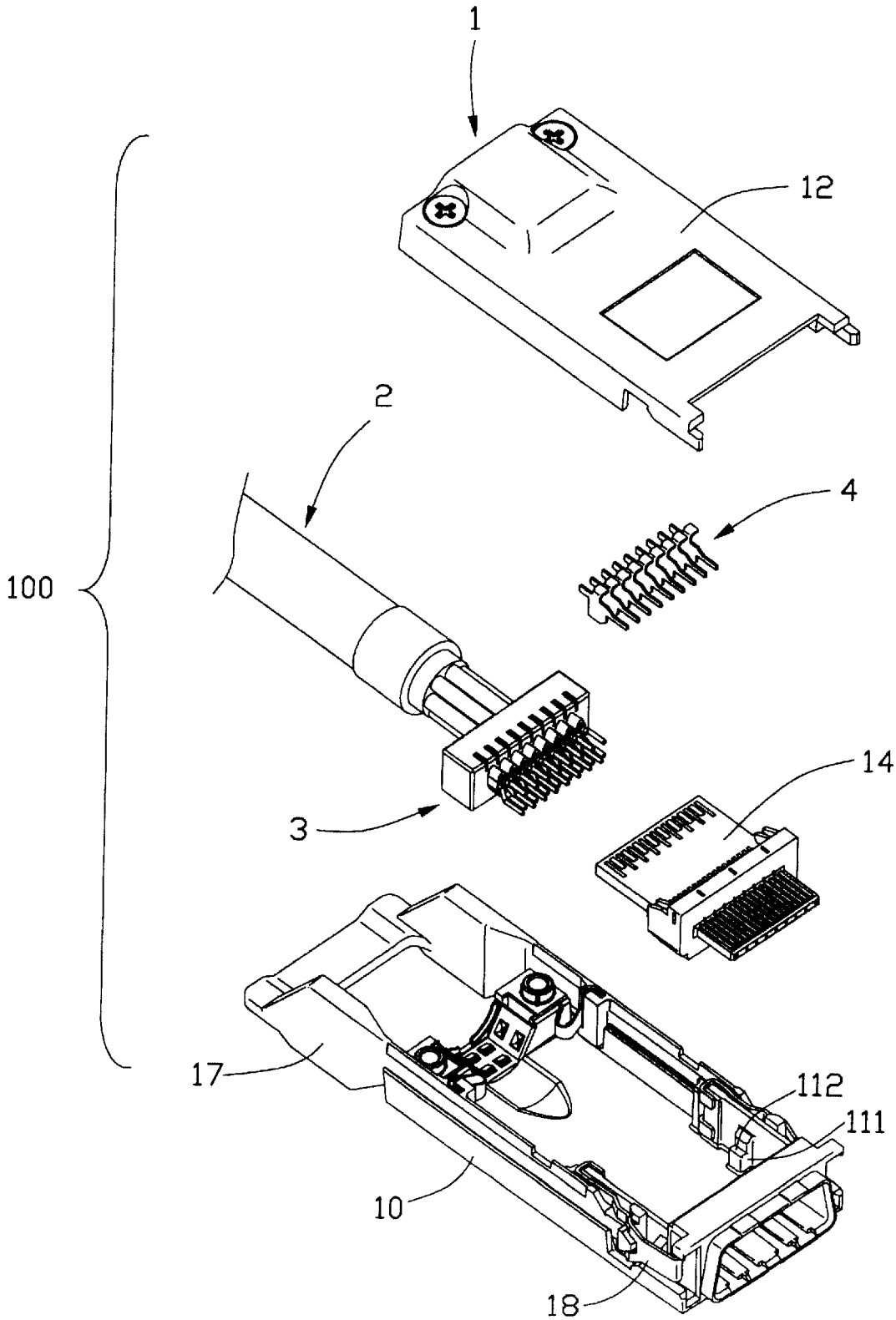
FIG. 1 is an exploded, perspective view of a cable connector assembly in accordance with the present invention.

Reference will now be made to the drawing figures to describe the present invention in detail.

Referring to FIG. 1, a cable connector assembly 100 of the present invention includes an electrical connector 1, a cable 2 terminated with the connector 1, a spacer 3 attached to an end of the cable 2, and a number of ground plates 4.

Referring now to FIGS. 2 and 2A–2D, which illustrate detailed configuration of the electrical connector 1, the electrical connector 1 of the preferred embodiment comprises a base member 10, a cover member 12 assembled on the base member 10, a terminal holder 14 received in a space defined between the base member 10 and the cooperated, cover member 12, a pair of screws 16, a pull tab 17 and a pair of latch springs 18.

Figure 2:
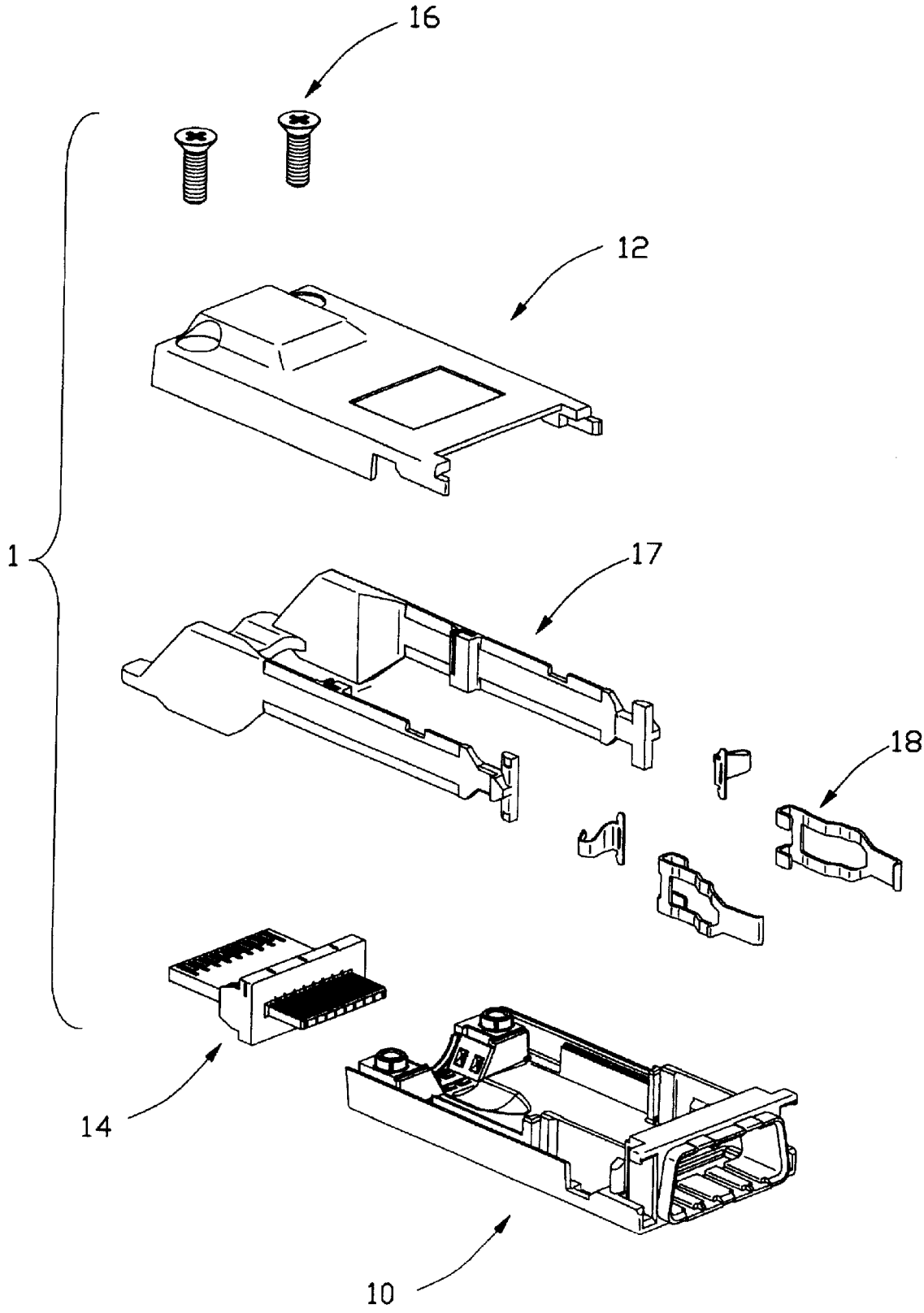
FIG. 2 is an enlarged, exploded perspective view of an electrical connector of the cable connector assembly.
Figure 2A:
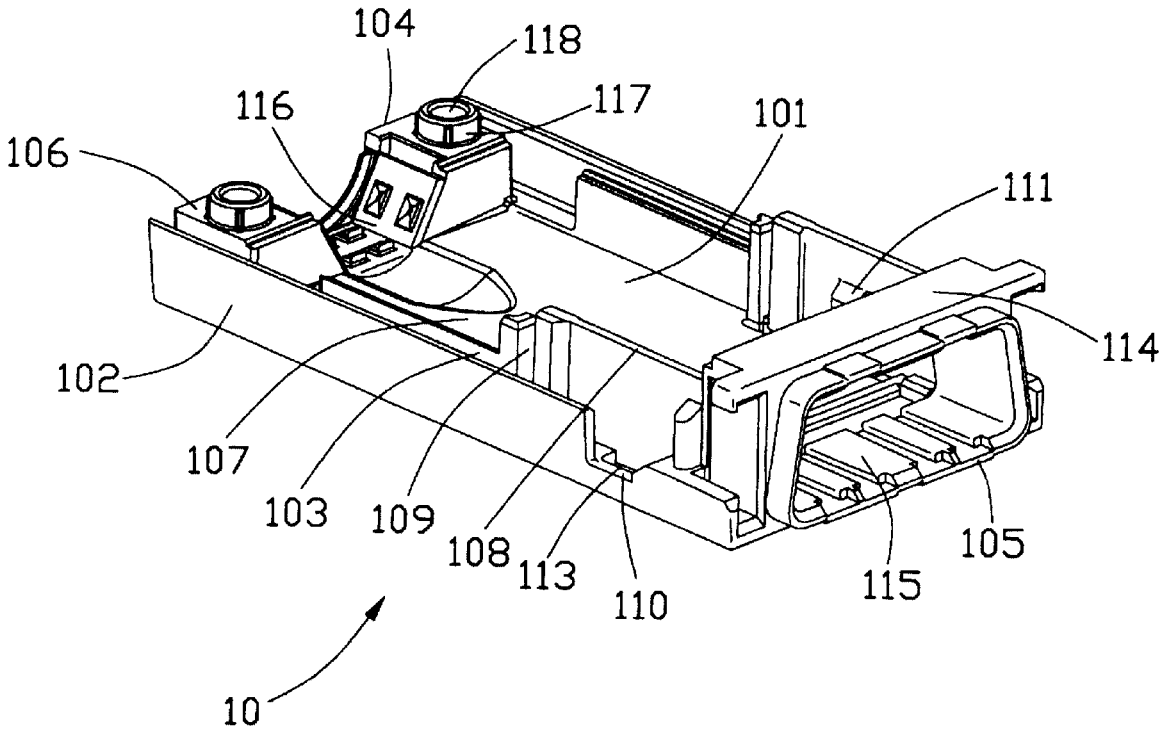
FIG. 2A is an enlarged, perspective view of a base member shown in FIG. 2.
Figure 2B:
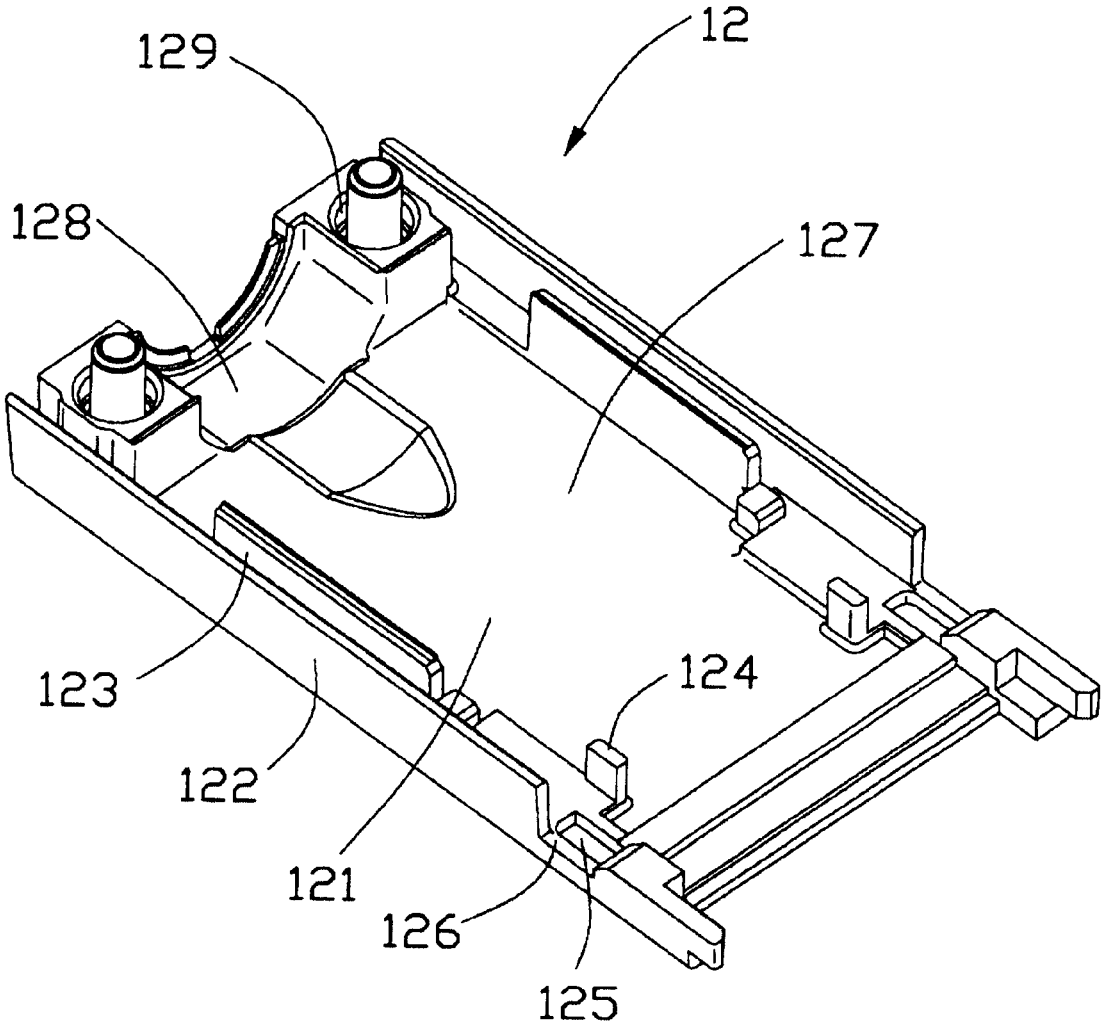
FIG. 2B is an enlarged, perspective view of a cover member shown in FIG. 2.

Both the base member 10 and the cover member 11 are formed by die casting metallic material, e.g., aluminum alloy. As best shown in FIGS. 2A and 2B, the base member 10 has a receiving space 107 surrounded by a base plate 101 and a pair of sidewalls 102 which upwardly extend from opposite lateral sides of the base plate 101. Each sidewall 102 defines therealong a channel 103 extending from a rear end 104 to a front end 105 and exposed to an engaging face 106 of the base member 10. Inside each sidewall 102, a shoulder portion 108 is formed adjacent to the front end 105 and defines a vertical slit 109 at a rear side thereof. Outside each sidewall 102, a cutout 110 is defined adjacent to the front end 105. A pair of blocks 111 is further formed on inner sides of the shoulder portions 108 and each block 111 defines thereon a mounting edge 112 (FIG. 1) for receiving the terminal holder 14, which will be described in great detail hereinafter.

The base plate 101 of the base member 10 defines a pair of depressions 113 located respectively between the shoulder portions 108 and corresponding cutouts 110. The base member 10 also forms a mating section 114 at the front end 105. The mating section 114 defines an mating opening 115 through the front end 105 and a pair of engaging channel 103 in opposite sides thereof. At the rear end 104 of the base member 10, a semicircular opening 116 is provided for the extension of the cable 2. A pair of posts 117 each with a screw hole 118 defined therethrough are arranged at opposite sides of the opening 116, respectively.

Particularly referring to FIG. 2B, the cover member 12 defines a receiving space 127 surrounded by a cover plate 121 and a pair of sidewalls 122 extending straightly from opposite lateral sides of the cover plate 121. Each sidewall 122 defines a channel 123 therealong corresponding to the channel 103 of the base member 10. A pair of lumps 124 extends downwardly from the cover plate 121 in correspondence with the blocks 111 of the base member 10 for cooperating with the blocks 111 to thereby secure a printed circuit board 142 (FIG. 5) of the terminal holder 14 in appropriate position. A pair of depressions 125, in correspondence with the depressions 113 in the base member 10, is defined in the cover plate 121. Similarly, a pair of cutouts 126 is defined in respective sidewalls 122 corresponding to the cutouts 110 defined in the base member 10. A semicircular opening 128 is provided in a rear end of the cover member 12 in correspondence with the opening 116 of the base member 10. A pair of through-holes 129 is defined in opposite sides of the opening 128, each through-hole 129 having a diameter substantially equal to an outer diameter of each post 117 of the base member 10.

Figure 2C:
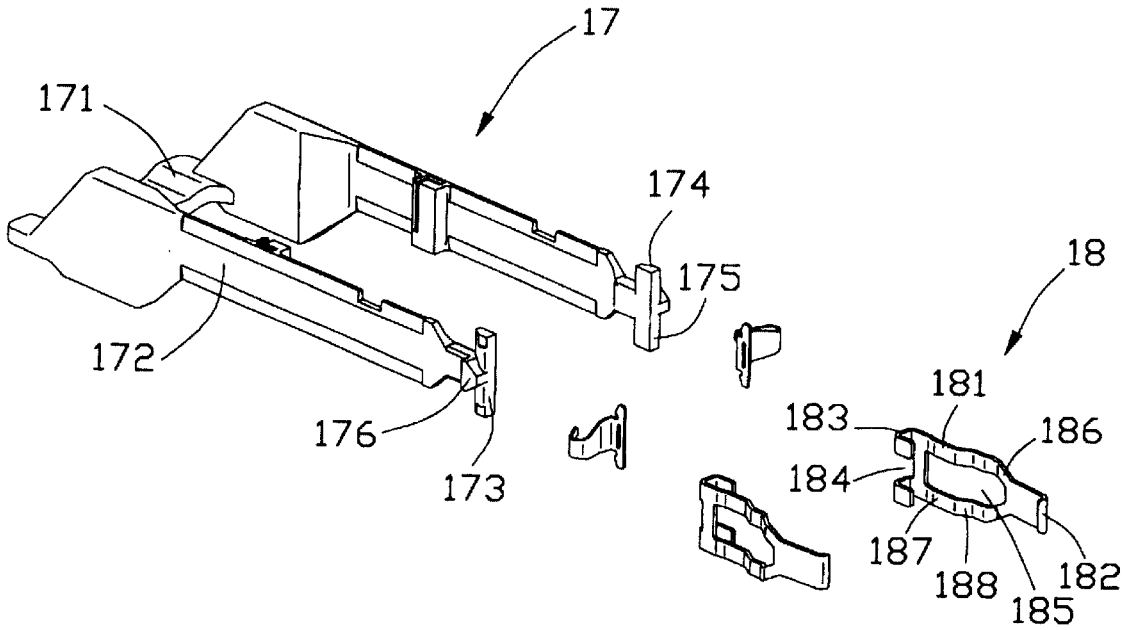
FIG. 2C is an enlarged, perspective view of a pull tab and a pair of latch springs shown in FIG. 2.

Turning to FIG. 2C, the pull tab 17 and the pair of latch springs 18 are shown separately. Specifically, each of the latch springs 18 is formed by stamping a metal sheet and has a body 181, an L-shaped, engaging part 182 and a pair of U-shaped, hold pawls 183. The L-shaped, engaging part 182 and the U-shaped, hold pawls 183 oppositely extend from opposite ends of the body 181, respectively. A gap 184 is defined between the pair of U-shaped, hold pawls 183 and an elongated cutout 185 is defined along the length of the body 181. The body 181 includes a front portion 186 connecting with the engaging part 182, a rear portion 187 connecting with the pair of hold pawls 183, and an outwards, inclined portion 188 formed between the front and the rear portions 186, 187.

The pull tab 17 includes an operable portion 171, a pair of parallel arms 172 extending forwardly from opposite sides of the operable portion 171, and a pair of latch releasing portion 173 formed at distal ends of the arms 172, respectively. Each latch releasing portion 173 has upper and lower tip ends 174, 175, and an embossment 176 protruding outwardly from an outer face thereof between the upper and lower tip ends 174, 175.

Figure 2D:
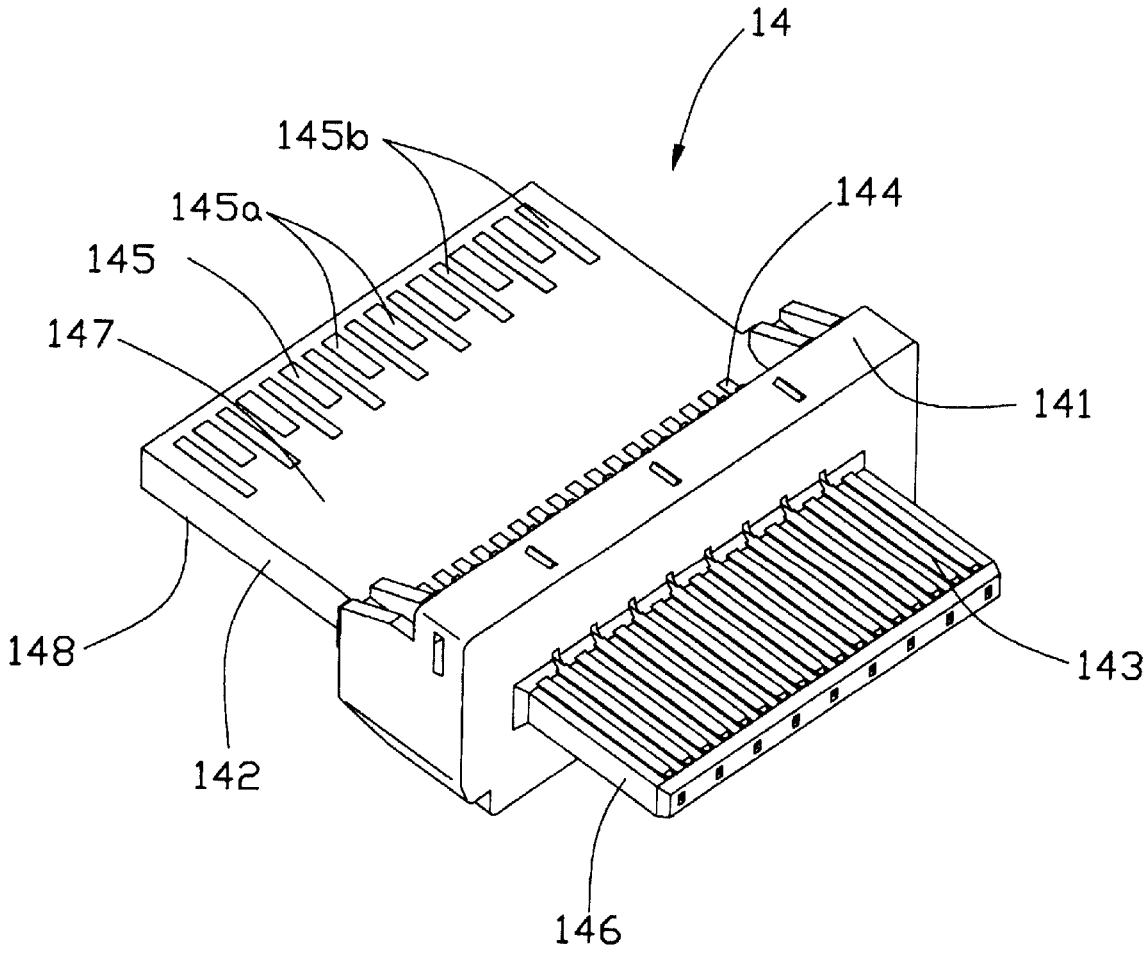
FIG. 2D is an enlarged, perspective view of a terminal holder shown in FIG. 2.

With reference to FIG. 2D, the terminal holder 14 of the electrical connector 1 is shown in detail. The terminal holder 14 comprises an insulating housing 141, the printed circuit board 142 assembled onto a rear side of the housing 141, and a plurality of conductive terminals 143 accommodated in the housing 141. The printed circuit board 142 has a number of first conductive pads 144 formed on a forward end of both top and bottom surfaces 147, 148 thereof and a number of second conductive pads 145 formed on a rearward end of the top and bottom surfaces 147, 148. Soldering portions of the terminals 143 are electrically soldered with the first conductive pads 144 and contacting portions of the terminals 143 are disposed in a tongue section 146 formed at a front end of the housing 141 for electrically connecting with a complementary connector (not shown). The second conductive pads 145 include signal pads 145*a* and ground pads 145*b*, which are alternatively arranged and electrically connected with respective first conductive pads 144 via corresponding signal circuits and ground circuits (not shown) in the printed circuit board 142, respectively. As detailedly shown, the ground pads 145*b* is a little longer than the signal pads 145*a* for the known purpose.

Turning back to FIG. 2 in conjunction with FIGS. 2A–2D, in subassembly the electrical connector 1, the terminal holder 14 is assembled to the base member 10 with the tongue section 146 received in the mating opening 115. The printed circuit board 142 is located in the receiving space 107 of the base member 10 and seated upon the mounting edges 112 of the blocks 111. The two latch springs 18 are respectively assembled to the pull tab 17 by extending the embossments 176 into the cutouts 185 from inner faces of the latch springs 18, whereby the latch releasing portions 173 engage with the inner faces of the latch springs 18, respectively. Then, the latch springs 18 together with the pull tab 17 are assembled to the base member 10. The arms 172 of the pull tab 17 extend in the channels 103 of the base member 10 with the operable portion 171 located outside the rear end 104 of the base member 10. The U-shaped, hold pawls 183 are partially received in the slits 109 of the shoulder portions 108 and engage with the rear ends of the shoulder portions 108 to secure the latch springs 18 on the base member 10. Lower ends of the latch releasing portions 173 are accommodated in corresponding depressions 113.

The L-shaped, engaging parts 182 are housed at opposite sides of the front end 105 of the base member 10 for latching with the complementary connector.

Figure 3:
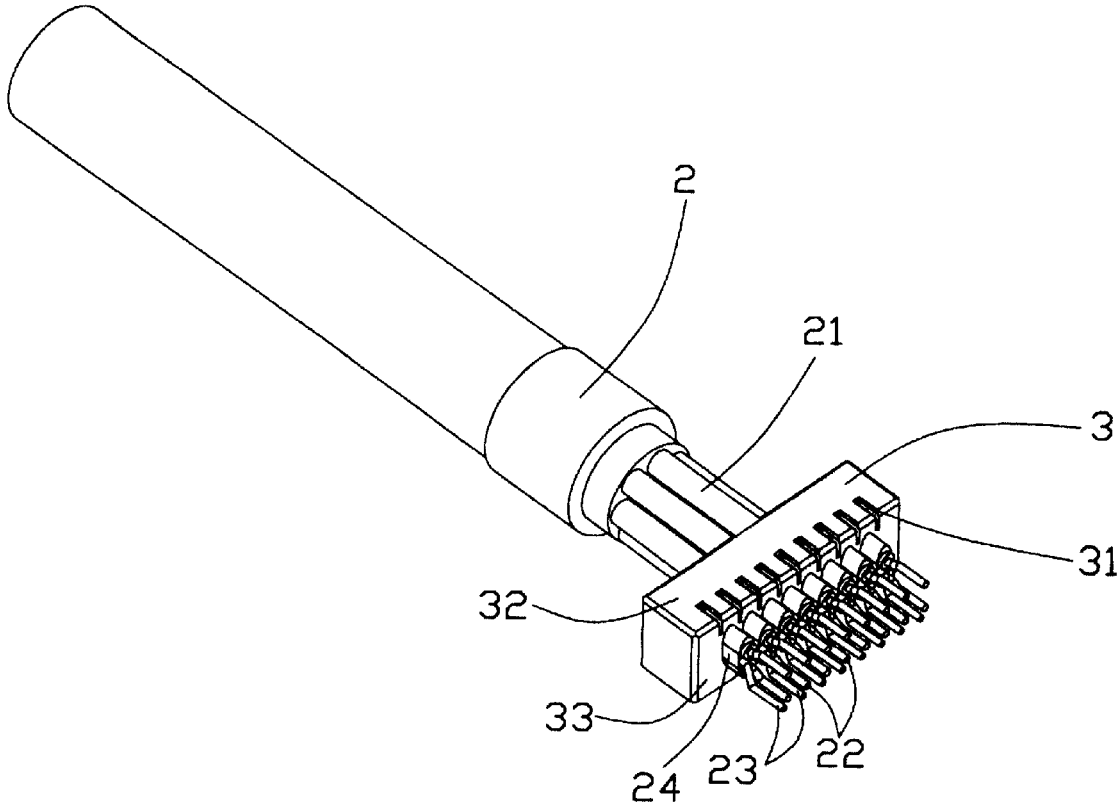
FIG. 3 is an enlarged, perspective view of a cable shown in FIG. 1 with a spacer being attached thereon.

Particularly referring to FIG. 3, the cable 2 of the present invention is illustrated with the spacer 3 attached thereon. The cable 2 comprises a plurality of wires 21, each wire having a pair of signal conductors 22 isolated from each other which are used to transmit same signal while in opposite directions and a drain wire 23. The two signal conductors 22 and the drain wire 23 are wrapped around by a conductive shield 24. The shield 24 is provided for electrically connecting to the ground plate 4, which will be described in great detail hereinafter.

The spacer 3 is made of insulating material and assembled on an end of the cable 2 to expose a length of stripped wires 21. A plurality of slits 31 is defined on a top surface 32 of the spacer 3 and presented on a forward face 33.

Figure 4A:
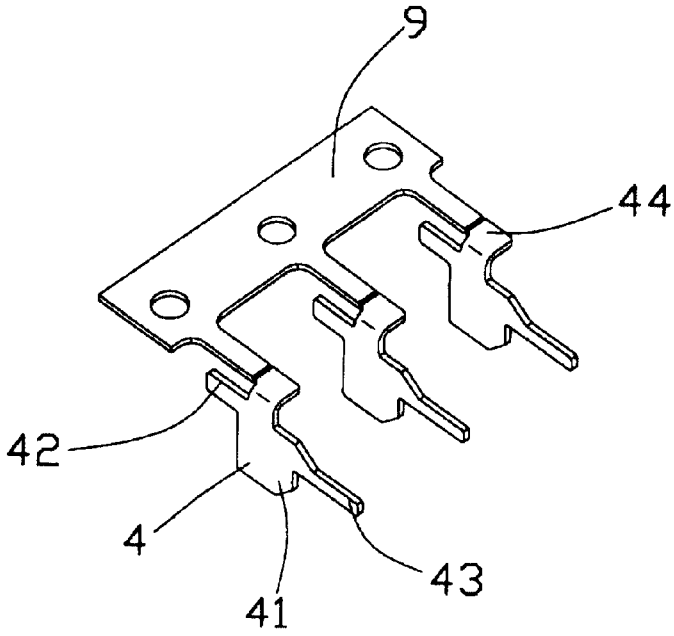
FIG. 4A is an enlarged, perspective view of a number of semi-manufactured ground plates shown in FIG. 1.
Figure 4B:
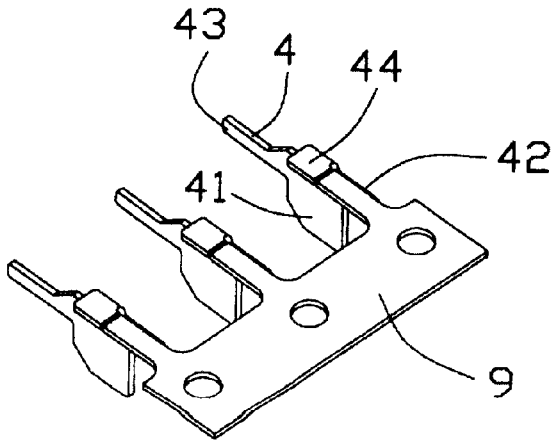
FIG. 4B is a view similar to FIG. 4A while taken from a different angle.
Figure 15:
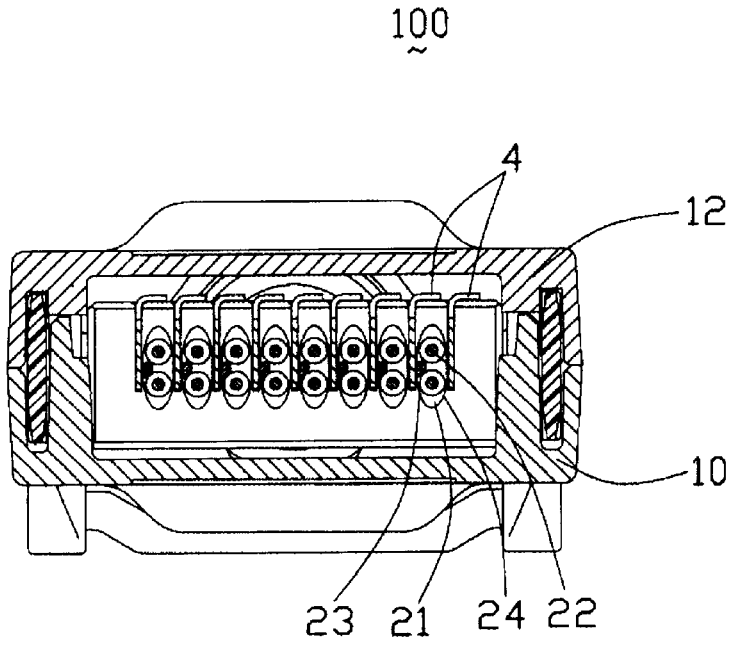
FIG. 15 is an enlarged cross-sectional view of the cable connector assembly shown in FIG. 11 taken along line 15—15.

Turning to FIGS. 4A and 4B, there is shown semi-manufactured ground plates 4, with which a carrier 9 is connected. Each ground plate 4 includes a body portion 41, a curved portion 44 at about 90 degrees, and a retaining portion 42, a soldering portion 43 respectively extending from opposite ends of the body portion 41 along opposite directions. The retaining portion 42 is configured to be received in corresponding slit 31 of the spacer 3 with the body portion 41 separating adjacent two stripped wires 21 from each other and conductively contacting to corresponding shields 24 (FIG. 15).

Figure 5:
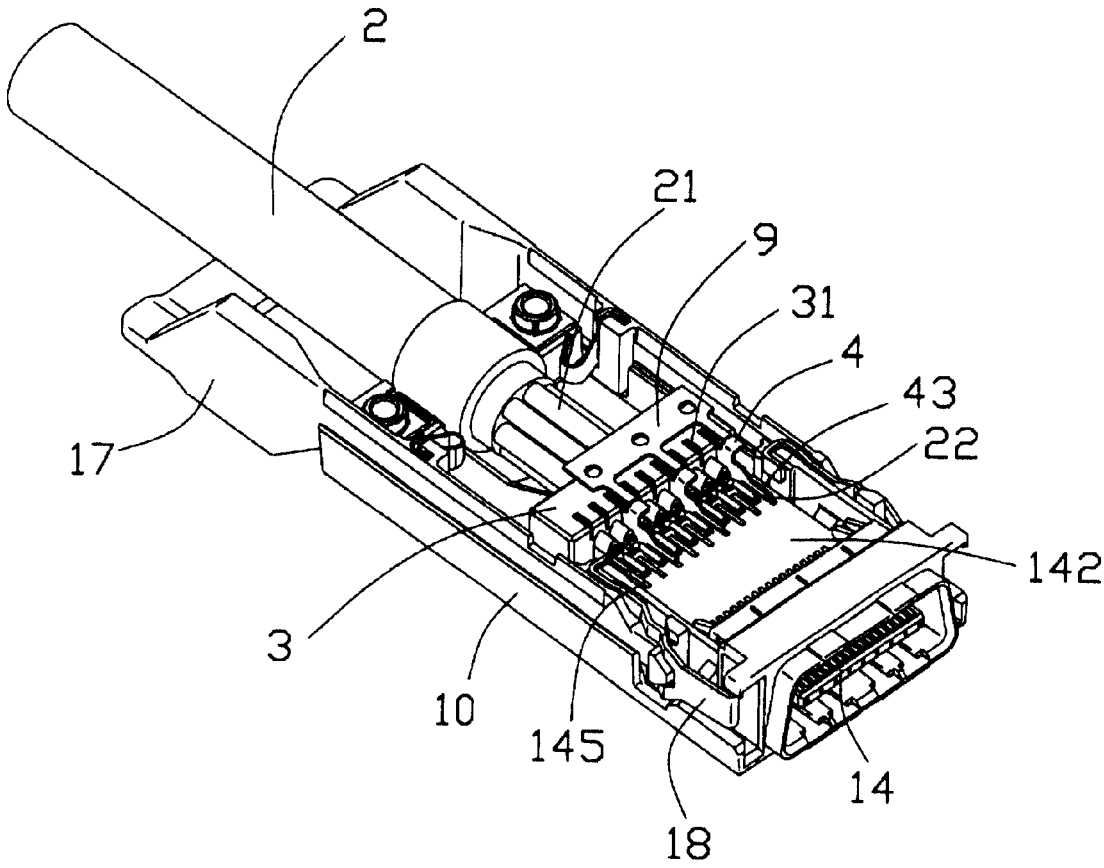
FIG. 5 is a partially assembled, perspective view of the cable connector assembly with a number of semi-manufactured ground plates attached thereon.
Figure 6:
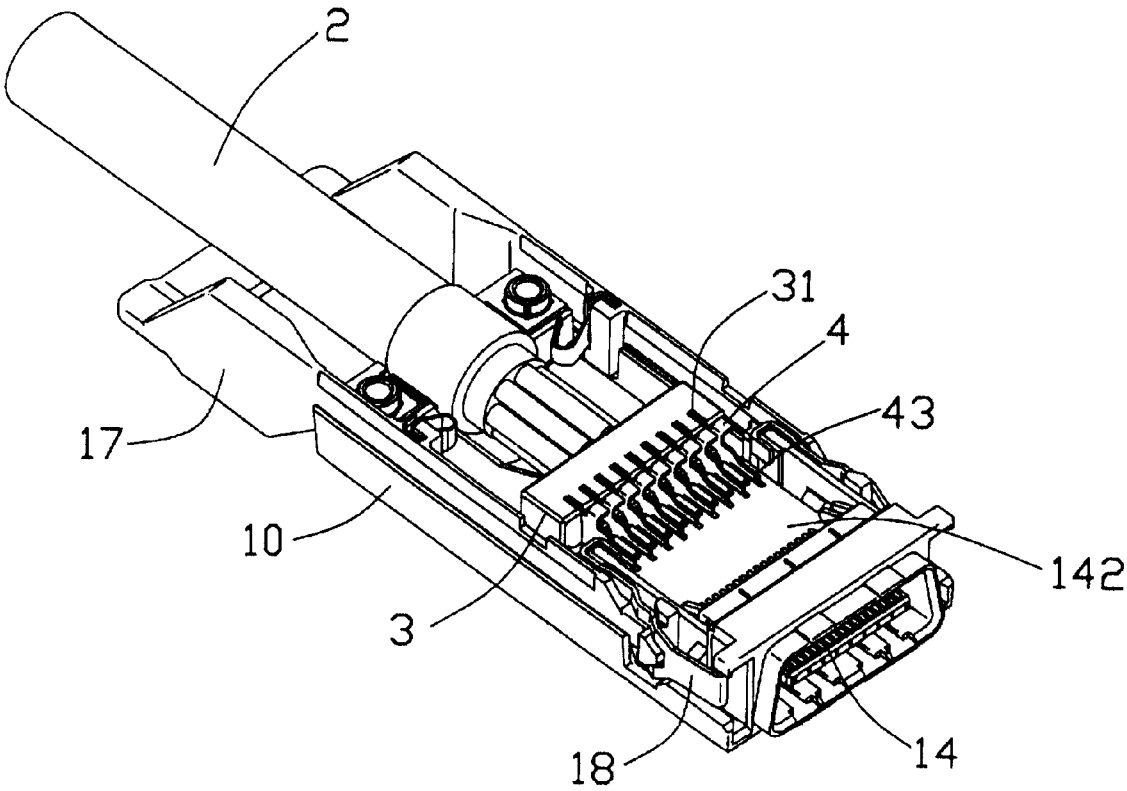
FIG. 6 is a view similar to FIG. 5 while with a number of finished ground plates attached thereon.
Figure 7:
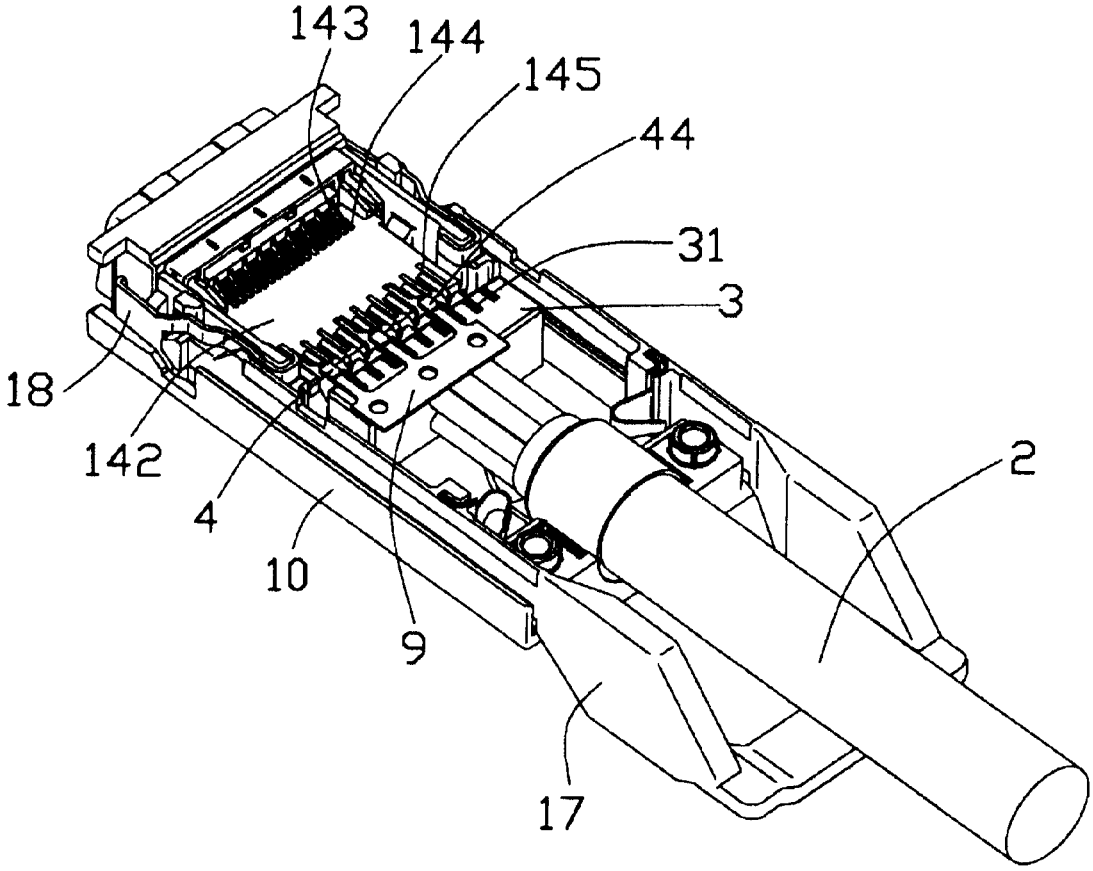
FIG. 7 is a view similar to FIG. 5 while from a different angle.
Figure 8:
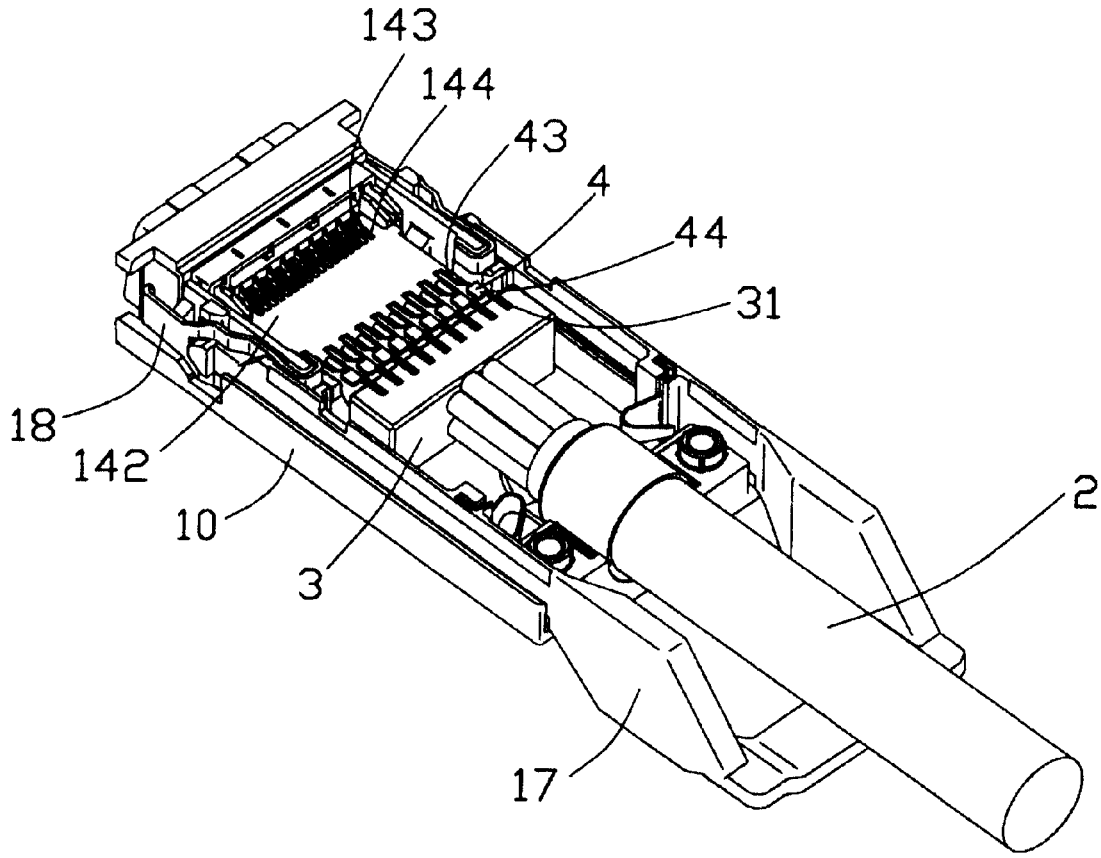
FIG. 8 is a view similar to FIG. 6 while from a different angle.

Together referring to FIGS. 5–8, the figures detailedly illustrate an assembled cable connector subassembly 200 without the cover member 12 attached thereon. FIGS. 5 and 7, from different angles, present the subassembly 200 has the ground plates 4 (only three are shown) accommodated between the stripped wires 21 with the carrier 9 connecting thereto. Correspondingly, FIGS. 6 and 8 show similar views of the subassembly while the ground plates 4 is substantially accommodated between the stripped wires 21 with the carrier 9 being removed therefrom. During assembly, the cable 2 extend between the arms 172 of the pull tab 17 and is received in the semicircular opening 116 of the base member 10 thereby the end of the cable 2 together with the spacer 3 attached thereon is retained in the receiving space 107.

Figure 16:
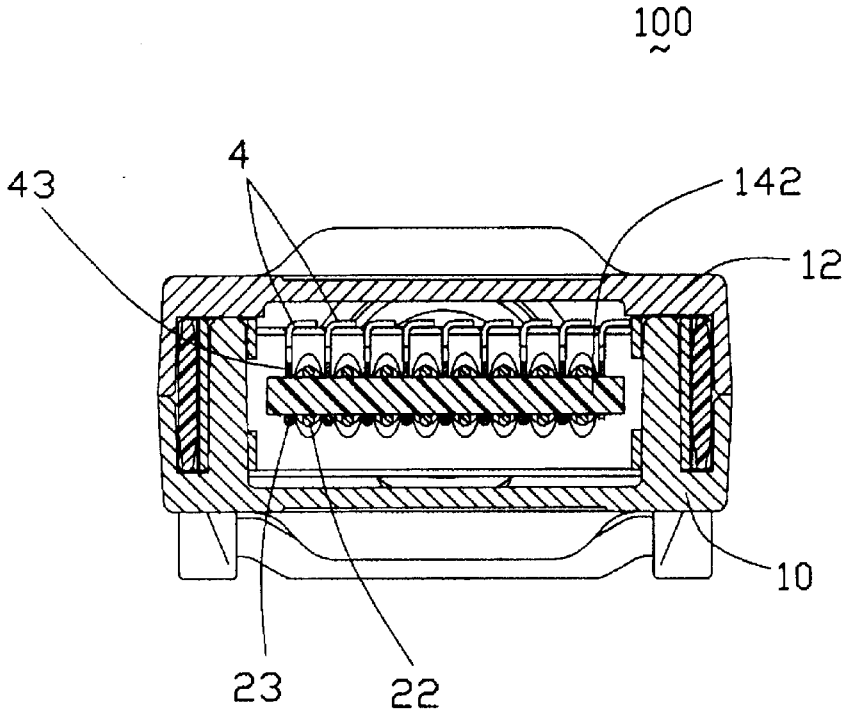
FIG. 16 is a view similar to FIG. 15 while taken along line 16—16.

Especially, the retaining portion 42 of each ground plate 4 is positioned in the corresponding slit 31 and the body portion 41 extends forwardly between the adjacent stripped wires 21, thereby aligning the soldering portion 43 with corresponding ground pad 145*b* of second conductive pad 145 on the top surface 147 and facilitating the soldering process between the soldering portion 43 and the corresponding ground pad 145*b*. The curved portion 44 of each ground plate 4 extends from an upper edge of the body portion 41 and crosses over an adjacent stripped wire 21 for shielding purpose, which can be seen easily from FIGS. 15 and 16. Meanwhile, the insulated, signal conductors 22 and the drain wires 23 are soldered with corresponding second conductive pads 145 positioned on both opposite surfaces 147, 148, which will be described in greater detail hereinafter.

Figure 9:
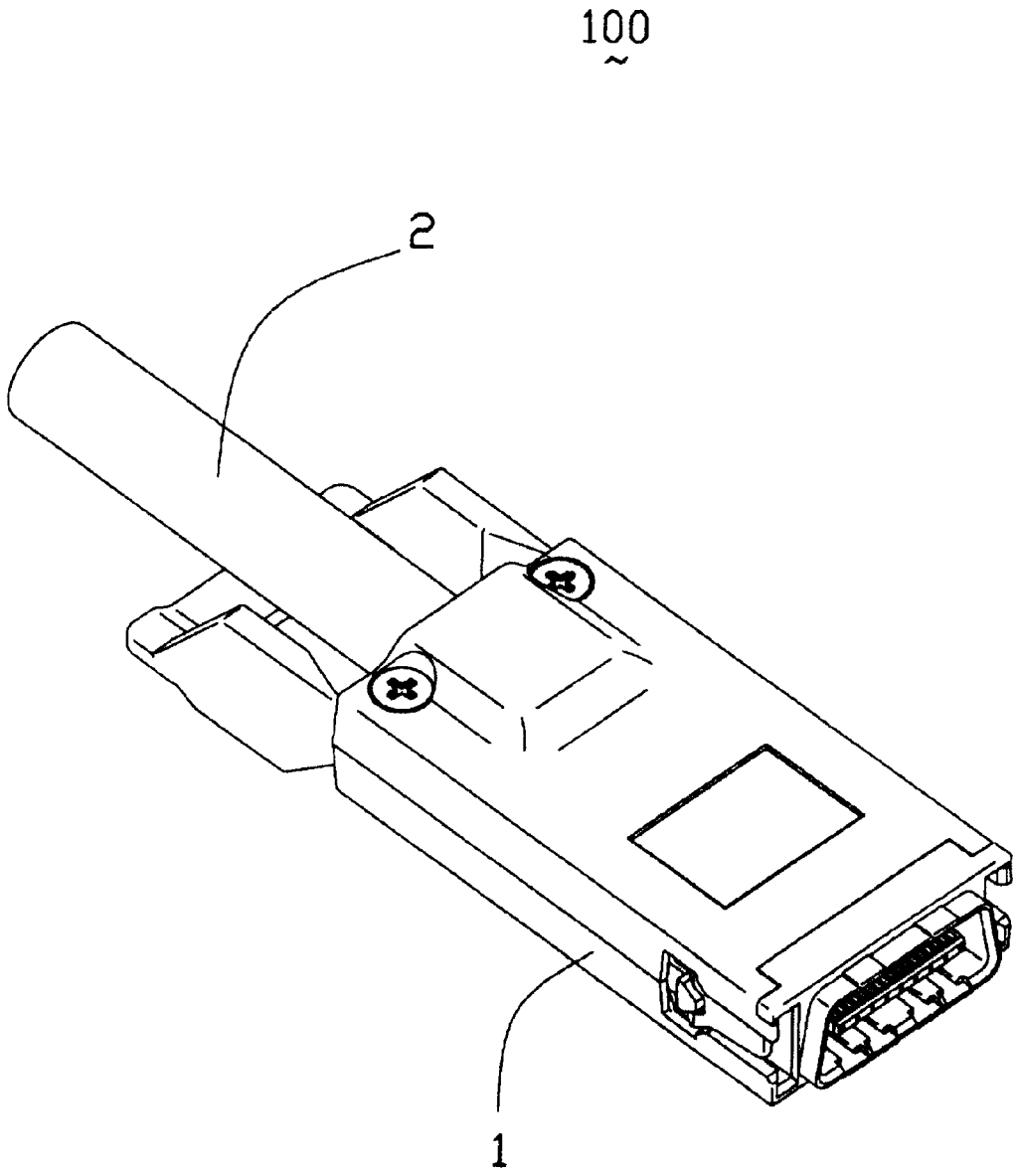
FIG. 9 is an assembled view of the cable connector assembly shown in FIG. 1.

FIG. 9 shows an assembled, perspective view of the cable connector assembly 100 of the present invention. The cover member 12 is attached onto the subassembly 200 with a bottom face of the cover member 12 intimately abuts against the top engaging face 106 of the base member 10. The pair of screws 16 are screwed into the screw holes 118 to securely fasten the cover member 12 and the base member 10 together, whereby the cable connector assembly 100 in accordance with the present invention is obtained.

Figure 10:
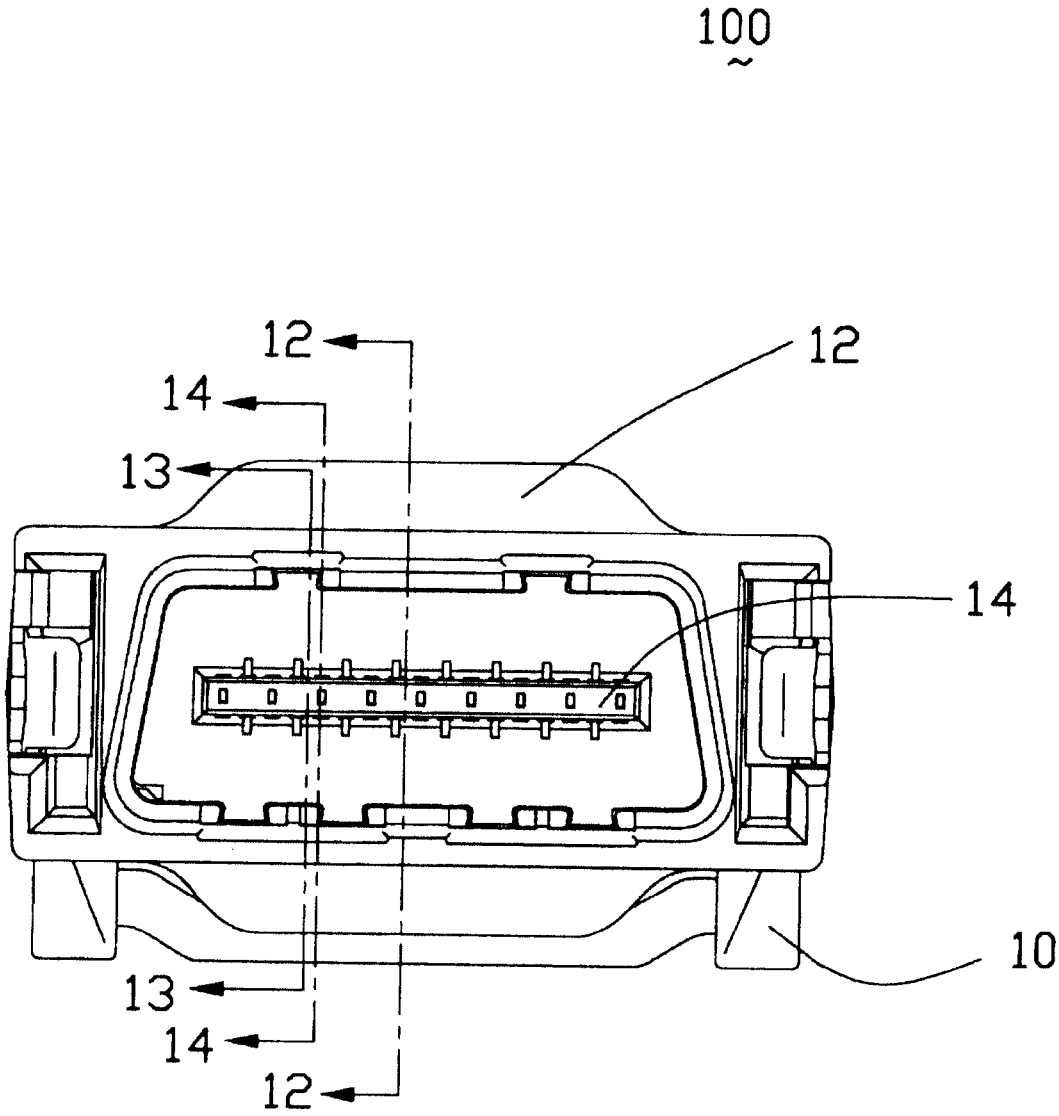
FIG. 10 is a front plan view of the cable connector assembly shown in FIG. 9.
Figure 11:
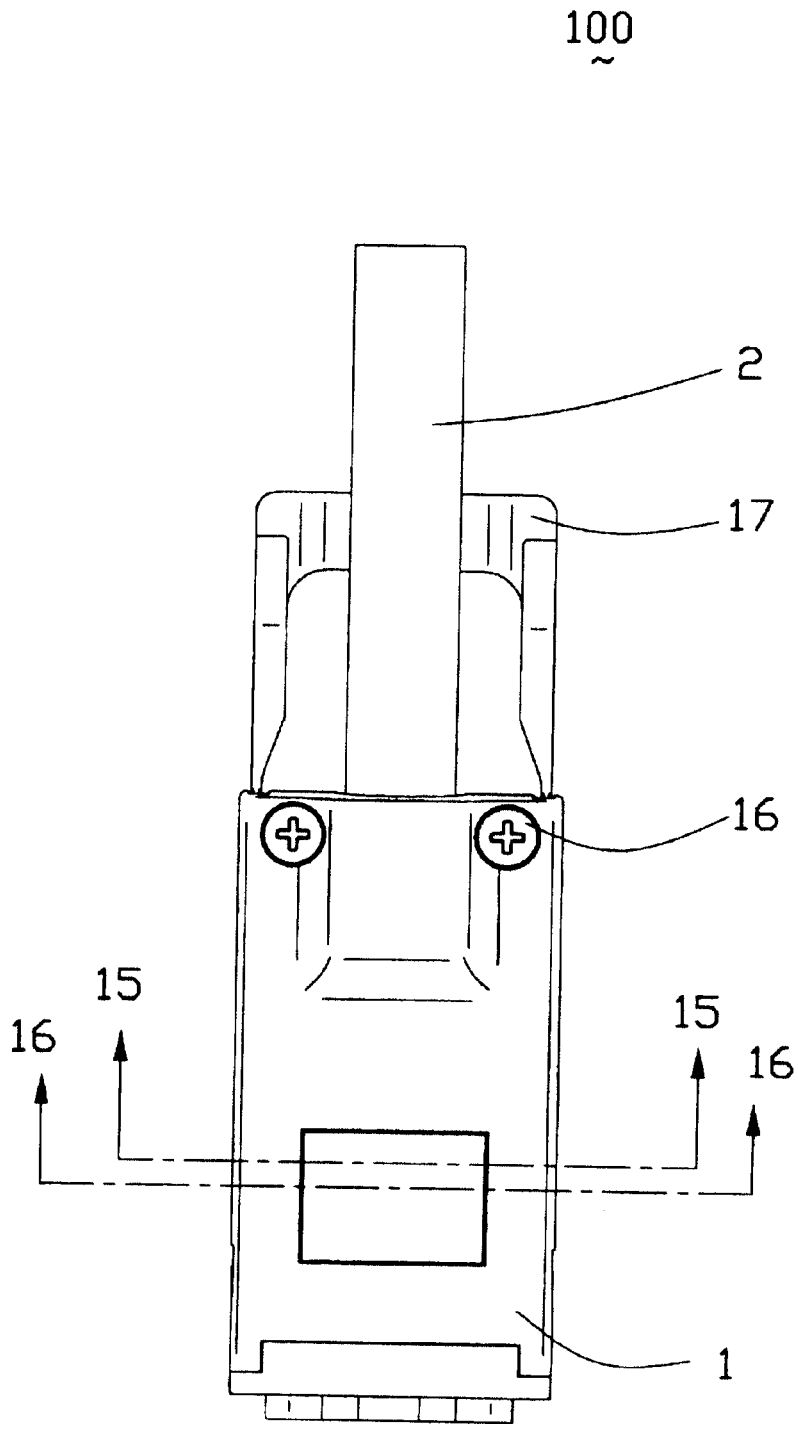
FIG. 11 is a top plan view of the cable connector assembly shown in FIG. 9.
Figure 12:
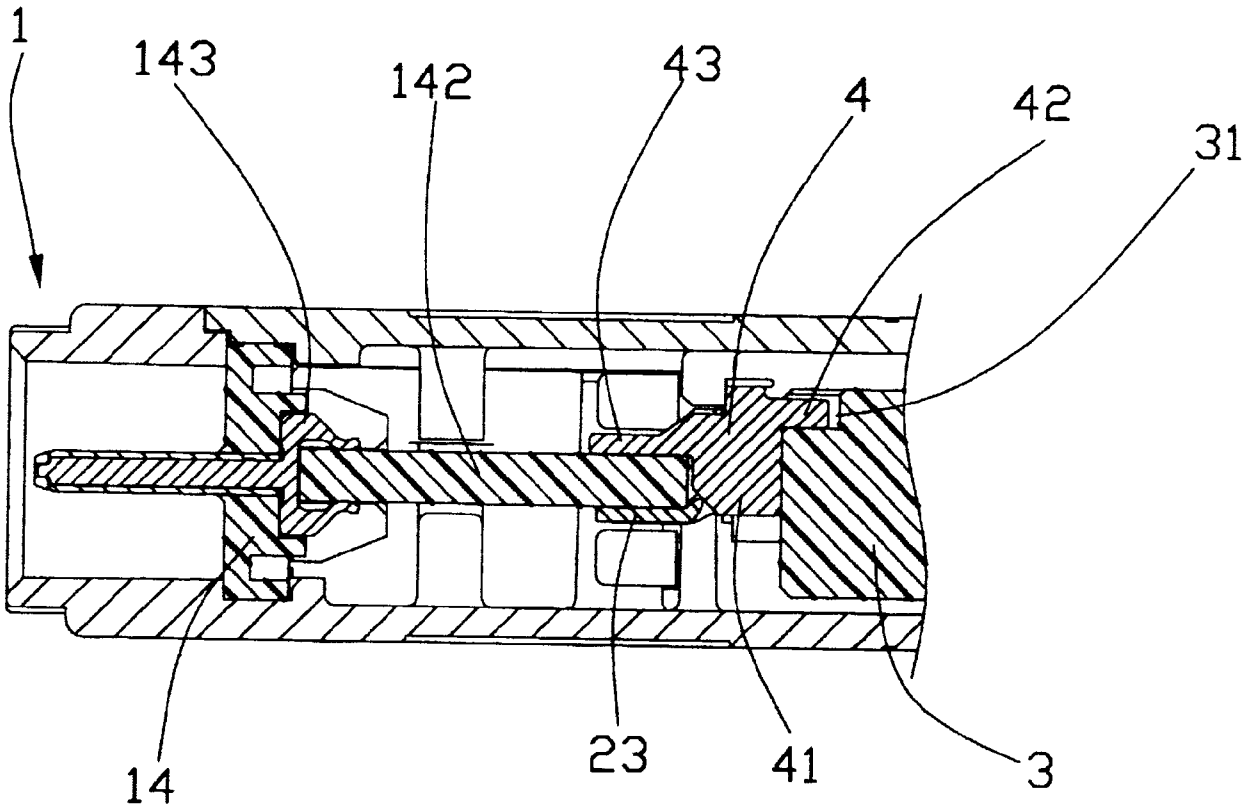
FIG. 12 is a partial enlarged cross-sectional view of the cable connector assembly shown in FIG. 10 taken along line 12—12.
Figure 13:
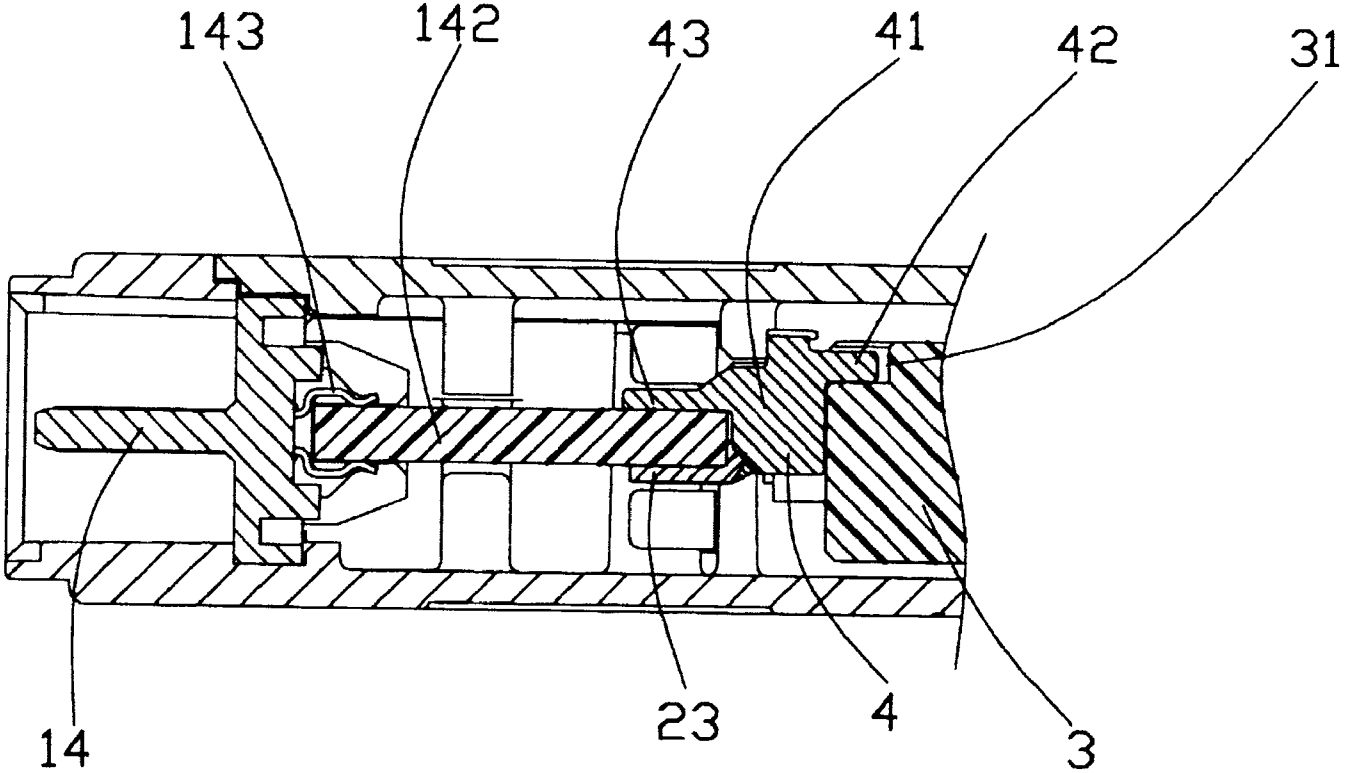
FIG. 13 is a view similar to FIG. 12 while taken along line 13—13.
Figure 14:
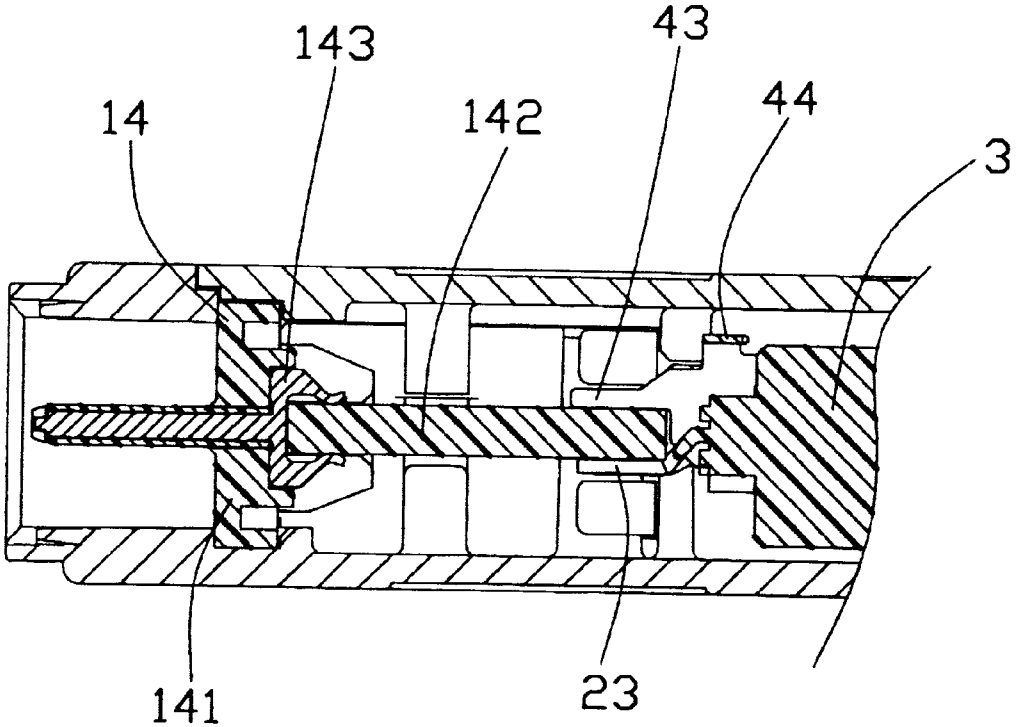
FIG. 14 is a view similar to FIG. 12 while taken along line 14—14.

Referring to FIGS. 12–16 in conjunction with FIGS. 10 and 11, in these figures, an inside structure of the cable connector assembly 100 is illustrated. Detailedly, the number of ground plates 4 retained in the corresponding slits 31 of the spacer 3 have the soldering portions 43 arranged on the top surface 147 of the printed circuit board 142 and soldered to the corresponding ground pads 145*b* of the second conductive pads 145, thereby establishing a first ground path from the complementary connector to the cable 3 and vice versa. Meanwhile, the drain wires 23 of the cable 2 are positioned on a plane under the bottom surface 148 of the printed circuit board 142, in correspondence with the soldering portions 43 of the ground plates 4, and soldered onto the corresponding ground pads 145*b* of the second conductive pads 145. Thus, a second ground path is established between the complementary connector and the cable 2.

Specifically, as shown in FIG. 15, each pair of insulated, signal conductors 22 of each wire 21 are positioned respectively on opposite surfaces 147, 148 of the printed circuit board 142 between adjacent two soldering portions 43 and drain wires 23. The insulated, signal conductors 22 are soldered onto the corresponding signal pads 145*a* located on top and bottom surfaces 147, 148 of the printed circuit board 142 so that establishing signal paths between the complementary connector and the cable 2.

It should be noted here that, during transmitting data at relative high speed, the employment of the ground plates 4 significantly reduces the crosstalk occurred on the soldering area of the signal conductors 22 where the signal conductors 22 are soldered with corresponding conductive pads 145 on the printed circuit board 142, as well as between every two adjacent signal conductors 22. More important, the soldering portions 43 of the ground plates 4 and the drain wires 23 are arranged in such a manner as described instantly that the crosstalk is tremendously lessened. In other words, the signal integrality transmitted between the complementary connector and the cable is substantially ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly comprising:

a cable subassembly including a cable having a plurality of wire units, a spacer organizing said wire units, and a ground device disposed between said wire units, each wire unit comprising a pair of signal wires and a ground wire; and an electrical connector adapted for electrically interconnecting said cable and a complementary connector, and comprising a shroud and a conductive device received in said shroud for providing electrical path between said cable and said complementary connector;

wherein there are two ground paths established from said ground device to said conductive device and from each of said ground wires to said conductive device, respectively, said two ground paths being located at opposite sides with respect to said conductive device such that substantially reducing crosstalk occurred during transmitting high rate data from said complementary connector to said cable; wherein said spacer defines a plurality of slits thereon, and wherein said ground device comprises a plurality of ground plates and each ground plate has a retaining portion received in corresponding slit, an intermediate portion conductively contacting to corresponding ground wire and separating adjacent two wire units, and a soldering portion soldering to said conductive device, wherein said conductive device comprises a terminal holder accommodating a plurality of terminals thereon, and a printed circuit board assembled on said terminal holder and electrically connecting to said terminals at a front end; wherein said printed circuit board arranges ground pads on opposite surfaces thereof, wherein said ground wires are organized on a plane and soldered to corresponding ground pads on one surface while said soldering portions of said ground plates are soldered to corresponding ground pads on an opposite surface of said printed circuit board; wherein said printed circuit board also provides a number of signal pads on said opposite surfaces thereof, said signal pads being alternately arranged between said ground pads and electrically connecting with said signal wires, respectively and correspondingly.

2. The cable connector assembly as described in claim 1, wherein said shroud includes a cover member and a base member cooperating with said cover member to providing a space for connection between said cable subassembly and said conductive device.

3. The cable connector assembly as described in claim 1, wherein said electrical connector further comprises a fastening means for interlocking said cover member with said base member.

4. The cable connector assembly as described in claim 1, wherein said electrical connector further comprises a pull tab and a latch spring attached on said pull tab, both of which arc assembled onto said cover member and said base member.

5. The cable connector assembly as described in claim 1, wherein each of said wire unit has a shield wrapping around said pair of signal wires and said ground wire, and said ground device electrically contacts to said shields for protecting said cable from EMI.

6. A cable connector assembly, comprising:

a cable having a number of wire groups, each wire group including a ground wire and at least one signal wire;

a ground device comprising a number of ground plates disposed between said wire groups and electrically connecting with corresponding ground wires; and an electrical connector, comprising a shroud defining therein a space for accommodating said ground device and an end of said cable;

a terminal holder received in a front portion of said shroud and arranging thereon a number of terminals; and a printed circuit board electrically connected with said terminals at an end thereof, said printed circuit board having rows of conductive pads arranged on the other end and disposed on opposite surfaces thereof, respectively, each row of conductive pads including alternatively positioned, signal and ground pads, wherein said signal pads are electrically connected with said signal wires, said ground pads on one surface are electrically connected with said ground plates, and said ground pads on opposite surface are electrically connected with corresponding ground wires, further comprising an organizer attached on said cable for positioning said wire groups on a plane, said organizer defining a number of slits thereon; wherein said ground plates each comprise a retaining portion retained in corresponding slit of said organizer so as to secure said ground plate aligning with corresponding ground pad, a soldering portion soldered to corresponding ground pad, and an intermediate portion interconnecting said retaining portion with said soldering portion.

7. The cable connector assembly as described in claim 6, wherein each wire group further includes a shield surrounding said ground wire and said at least one signal wire, said shield being conductive connecting with said ground wire.

8. The cable connector assembly as described in claim 6, wherein said electrical connector further comprises a latching device comprising a pull tab and a latch spring cooperating with said pull tab.

9. The cable connector assembly as described in claim 6, wherein said shroud is made of metal material and comprises a cover and a base, said cover being detachably assembled on said base.

* * * * *